US010493794B1

(12) United States Patent
Ryan

(10) Patent No.: US 10,493,794 B1
(45) Date of Patent: Dec. 3, 2019

(54) PAINT ROLLER SYSTEMS

(71) Applicant: Michael D. Ryan, Scottsdale, AZ (US)

(72) Inventor: Michael D. Ryan, Scottsdale, AZ (US)

( * ) Notice: Subject to any disclaimer, the term of this patent is extended or adjusted under 35 U.S.C. 154(b) by 121 days.

(21) Appl. No.: 15/813,086

(22) Filed: Nov. 14, 2017

Related U.S. Application Data

(60) Provisional application No. 62/497,189, filed on Nov. 14, 2016.

(51) Int. Cl.
*B44D 3/12* (2006.01)

(52) U.S. Cl.
CPC ..... *B44D 3/128* (2013.01)

(58) Field of Classification Search
CPC . B44D 3/00; B44D 3/12; B44D 3/128; B44D 3/14; B44D 3/16; B44D 3/162; B44D 3/164; B44D 3/166; B44D 3/168; B44D 3/18; B44D 3/185; B44D 3/22; B44D 3/225; B44D 3/24; B44D 3/38; B65D 85/00–84
USPC ..... 220/701
See application file for complete search history.

(56) References Cited

U.S. PATENT DOCUMENTS

| | | | | | |
|---|---|---|---|---|---|
| 4,240,568 | A * | 12/1980 | Pool | B44D 3/121 | 220/698 |
| 4,247,013 | A * | 1/1981 | O'Hori | B44D 3/128 | 15/257.05 |
| 4,911,319 | A * | 3/1990 | DeJean | B44D 3/128 | 220/700 |
| 5,195,662 | A * | 3/1993 | Neff | B44D 3/128 | 220/700 |
| 6,213,338 | B1 * | 4/2001 | Cogdill | B44D 3/128 | 220/570 |
| 6,705,480 | B1 * | 3/2004 | Saddler | B44D 3/12 | 220/4.03 |
| 2002/0139807 | A1 * | 10/2002 | Lucey | B44D 3/12 | 220/698 |
| 2010/0116834 | A1 * | 5/2010 | Sulick, Jr. | B44D 3/123 | 220/697 |
| 2012/0228316 | A1 * | 9/2012 | West | B44D 3/006 | 220/735 |
| 2015/0102045 | A1 * | 4/2015 | Nazlian | B44D 3/006 | 220/697 |
| 2015/0266337 | A1 * | 9/2015 | Abemethy, Jr. | B44D 3/128 | 222/570 |

* cited by examiner

*Primary Examiner* — Kareen K Thomas
(74) *Attorney, Agent, or Firm* — Lodestar Patents, PLLC; Raymond J. E. Hall

(57) ABSTRACT

A system for providing a way for painters to load a roller or brush with paint directly from the can/bucket with reduced dripping, ease of clean-up and storage.

16 Claims, 7 Drawing Sheets

PAINT ROLLER SYSTEMS

CROSS-REFERENCE TO RELATED APPLICATION

The present application is related to and claims priority from prior provisional application Ser. No. 62/497,189, filed Nov. 14, 2016, entitled "PAINT ROLLER TOOL", the contents of which is incorporated herein by this reference and is not admitted to be prior art with respect to the present invention by the mention in this cross-reference section.

BACKGROUND

This invention relates to providing a system for improved painting. More particularly this invention relates to providing a system for providing a way for painters to load a roller or brush with paint directly from the can/bucket with reduced dripping, ease of clean-up and storage. Paint cans comprise a tubular cylindrical casing having an opening at one end, an inwardly extending rim comprising an annular and inwardly extending groove into which the lid is secured in place. Paint buckets comprise a similar tubular cylindrical casing having an opening at one end. However, with paint buckets, the rim of the opening is upwardly extending comprising a shelf-like structure below the exterior of the rim; the lid comprises an annular and inwardly extending groove which fits over the rim of the bucket to seal the bucket.

The present invention provides a system for loading paint onto a roller or brush, which snaps onto a standard paint can/bucket and prevents dripping, paint from contacting the can/bucket itself, and once finished, unsnaps from the paint can/bucket leaving the paint can/bucket rim clean of paint for easy re-sealing and storage.

OBJECTS AND FEATURES OF THE INVENTION

A primary object and feature of the present invention is to provide a system overcoming the above-mentioned problem.

It is a further object and feature of the present invention to provide such a system to help prevent dripping of paint into/onto the rim of the paint can/bucket.

It is a further object and feature of the present invention to provide such a system to optimize ease of clean-up.

It is a further object and feature of the present invention to provide such a system provide a clean rim of the paint can/bucket allowing for easier re-sealing and storage of unused paint for future use.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to preventing paint from contacting a paint container rim while using paint directly from a paint container with a painting utensil, comprising: at least one paint container rim cover structured and arranged to cover the paint container rim; wherein such at least one paint container rim cover comprises at least one rim coupler structured and arranged to couple such at least one paint container rim cover with the paint container rim, at least one opening access structured and arranged to permit access inside the paint container with the painting utensil, at least one paint-scrape edge structured and arranged to permit scraping of excess paint from the paint utensil, and at least one paint drain structured and arranged to drain excess paint from such at least one paint scrape edge back into the paint container while preventing contact of paint with the paint container rim.

Moreover, it provides such a system further comprising at least one paint roller screen structured and arranged to permit screening out excess paint from a paint roller. Additionally, it provides such a system wherein such at least one paint roller screen and such at least one paint container rim cover comprise at least one screen-cover coupler structured and arranged to couple such at least one paint container rim cover and such at least one paint roller screen.

Also, it provides such a system wherein such at least one paint roller screen is positioned over such at least one opening access when coupled with such at least one paint container rim cover. In addition, it provides such a system wherein such at least one paint container rim cover comprises plastic. And, it provides such a system wherein such at least one paint roller screen comprises plastic. Further, it provides such a system wherein such at least one screen-cover coupler is decoupleable. Even further, it provides such a system wherein such at least one screen-cover coupler comprises at least one slot-and-tab coupler. Moreover, it provides such a system wherein such at least one paint container rim cover comprises: at least one inner cover structured and arranged to cover the paint container rim on the inside of the paint container; and at least one outer cover structured and arranged to cover the paint container rim on the outside of the paint container. Additionally, it provides such a system wherein such at least one paint drain comprises at least one sloped surface extending from such at least one paint scrape edge inward and downward to such at least one opening access.

In accordance with another preferred embodiment hereof, this invention provides a system, relating to preventing paint from contacting a paint container rim while using paint directly from a paint container with a painting utensil, comprising: paint container rim cover means for covering the paint container rim; wherein such paint container rim cover means comprises rim coupler means for coupling such paint container rim cover means with the paint container rim, opening access means for permitting access inside the paint container with the painting utensil, paint-scrape edge means for permitting scraping of excess paint from the paint utensil, and paint drain means for draining excess paint from such paint scrape edge means back into the paint container while preventing contact of paint with the paint container rim. Also, it provides such a system further comprising paint roller screen means for permitting screening out excess paint from a paint roller. In addition, it provides such a system wherein such paint roller screen means and such paint container rim cover means comprise screen-cover coupler means for coupling such paint container rim cover means and such paint roller screen means.

And, it provides such a system wherein such paint roller screen means is positioned over such opening access means when coupled with such paint container rim cover means. Further, it provides such a system wherein such paint container rim cover means comprises plastic. Even further, it provides such a system wherein such paint roller screen means comprises plastic. Even further, it provides such a system wherein such screen-cover coupler means is decoupleable.

Even further, it provides such a system wherein such screen-cover coupler comprises at least one slot-and-tab coupler. Even further, it provides such a system wherein such paint container rim cover means comprises: inner cover means for covering the paint container rim on the inside of the paint container; and outer cover means for covering the paint container rim on the outside of the paint container. Even further, it provides such a system wherein such paint drain comprises at least one sloped surface extending from such paint scrape edge means inward and downward to such opening access means. In accordance with a preferred embodiment hereof, this invention provides a system, relating to each and every novel feature, element, combination, step and/or method disclosed or suggested by this patent application.

DETAILED DESCRIPTION OF THE BEST MODES AND PREFERRED EMBODIMENTS OF THE INVENTION

Generally, when a painter is painting the exterior of a structure, wall of a room or any other paintable surface, current paint roller tools include the necessity to pour the paint out of the can into a "paint tray" of some sort and rolling the paint onto the roller from the tray. Other systems which may attach to the paint can/bucket do not help prevent the paint from dripping or flowing into/onto the rim of the paint can/bucket itself. This presents a problem with clean-up and storage. If the rim of the paint can/bucket is filled or covered with paint, it becomes more difficult to re-seal the paint can/bucket to store any leftover paint for future use.

Figure 1:
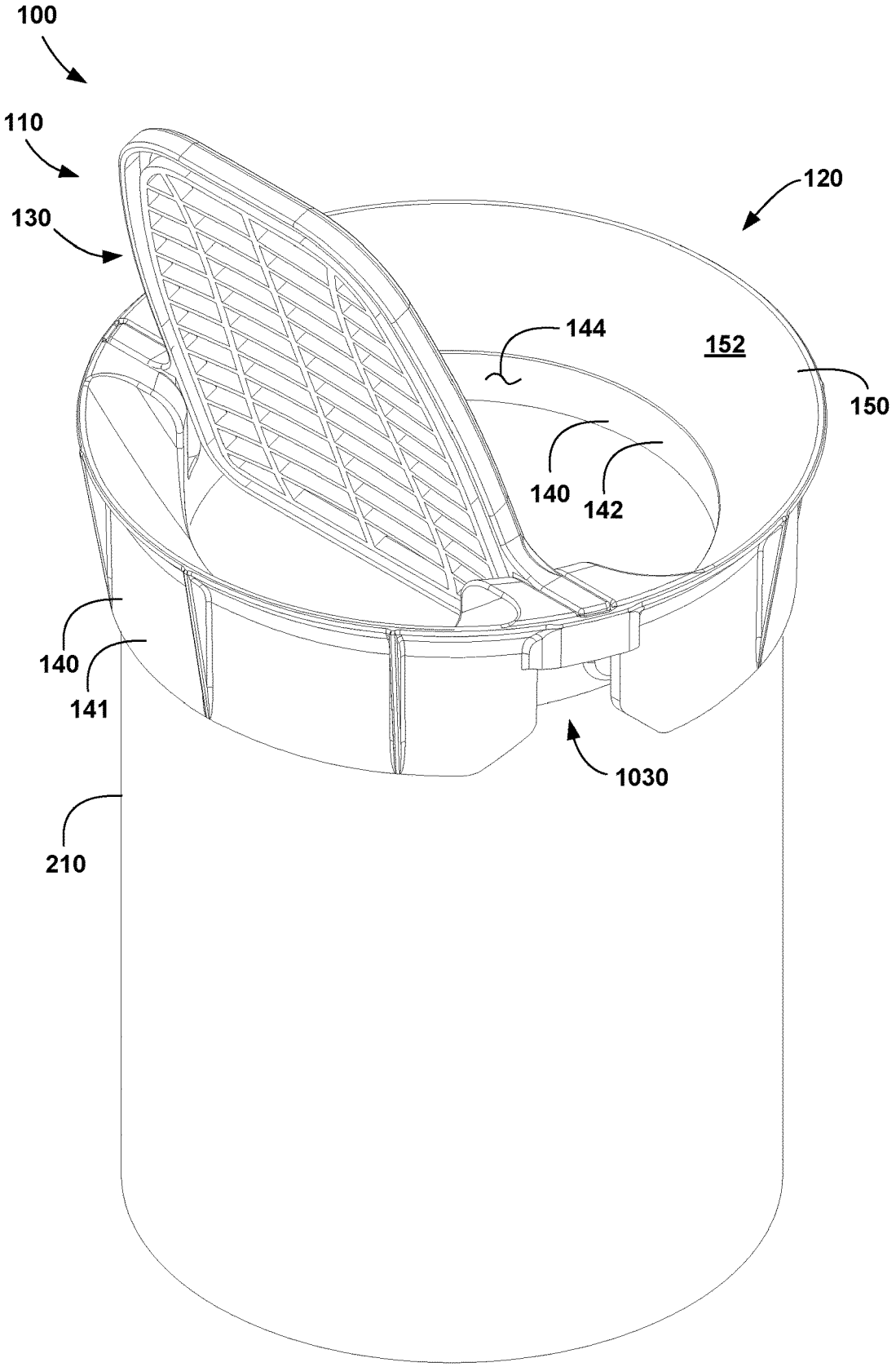
FIG. 1 shows a perspective view illustrating paint-vessel protector of paint roller-system according to an alternately preferred embodiment of the present invention.

FIG. 1 shows a perspective view of paint-vessel protector 110 (at least embodying herein at least one paint container rim cover structured and arranged to cover the paint container rim and at least embodying herein paint container rim cover means for covering the paint container rim) of paint-roller system 100 in use on a paint vessel according to a preferred embodiment of the present invention. Paint-vessel protector 110 preferably comprises vessel-rim protector 120 (at least herein embodying wherein said at least one paint container rim cover comprises at least one rim coupler structured and arranged to couple said at least one paint container rim cover with the paint container rim, and at least herein embodying wherein said paint container rim cover means comprises rim coupler means for coupling said paint container cover means with the paint container rim), as shown. Paint-vessel protector 110 preferably further comprises paint-tool scraper 130 (at least embodying herein at least one paint roller screen structured and arranged to permit screening out excess paint from a paint roller, and at least embodying herein paint roller screen means for permitting screening out excess paint from a paint roller), as shown.

Paint-roller system 100 preferably comprises a flexible material, preferably flexible plastic material, preferably polypropylene, alternately preferably polyethylene (at least herein embodying wherein said at least one paint container rim cover comprises plastic, and at least herein embodying wherein said paint container rim cover means comprises plastic, and at least herein embodying wherein said at least one paint roller screen comprises plastic, and at least herein embodying wherein said paint roller screen means comprises plastic). Upon reading the teachings of this specification, those skilled in the art will now appreciate that, under appropriate circumstances, considering such issues as, future manufacturing methods, cost, structural requirements, available materials etc., other materials, such as, for example a thermoplastic elastomer (TPE), thermoforming plastic, low density polyethylene, thermoplastic polyolefins, polyethylene terephthalate glycol, fabrics, rubbers, metals, silicons, polyolefin blends, elastomeric alloys, thermoplastic polyurethanes, thermoplastic copolyester, thermoplastic polyamids etc., may suffice.

Paint roller system 100 preferably comprises injection molding manufacturing. Injection molding preferably comprises a process for producing parts by injecting material into a mold. Material for the part is preferably fed into a heated barrel, preferably mixed, and preferably forced into a mold cavity, where it cools and hardens to the configuration of the cavity. Upon reading the teachings of this specification, those skilled in the art will now appreciate that, under appropriate circumstances, considering such issues as, future manufacturing methods, cost, structural requirements, available materials etc., other methods of manufacturing, such as, for example, blow molding, thermoforming, transfer molding, reaction injection molding, compression molding, extrusion, stamping, etc., may suffice.

Figure 8:
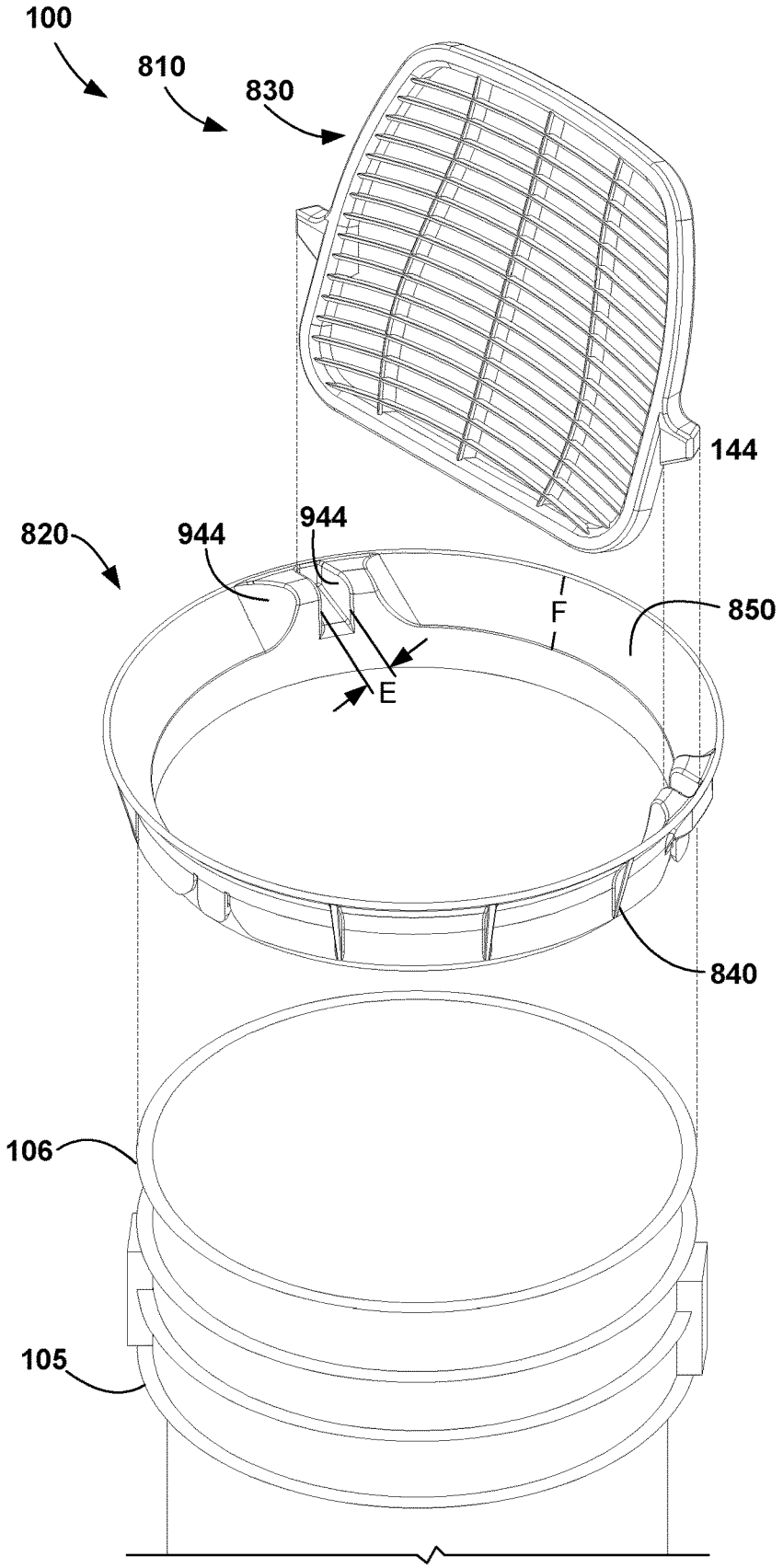
FIG. 8 shows an exploded perspective view of a paint-vessel protector, illustrating vessel-rim protector and paint-tool scraper according to a preferred embodiment of the present invention.
Figure 9:
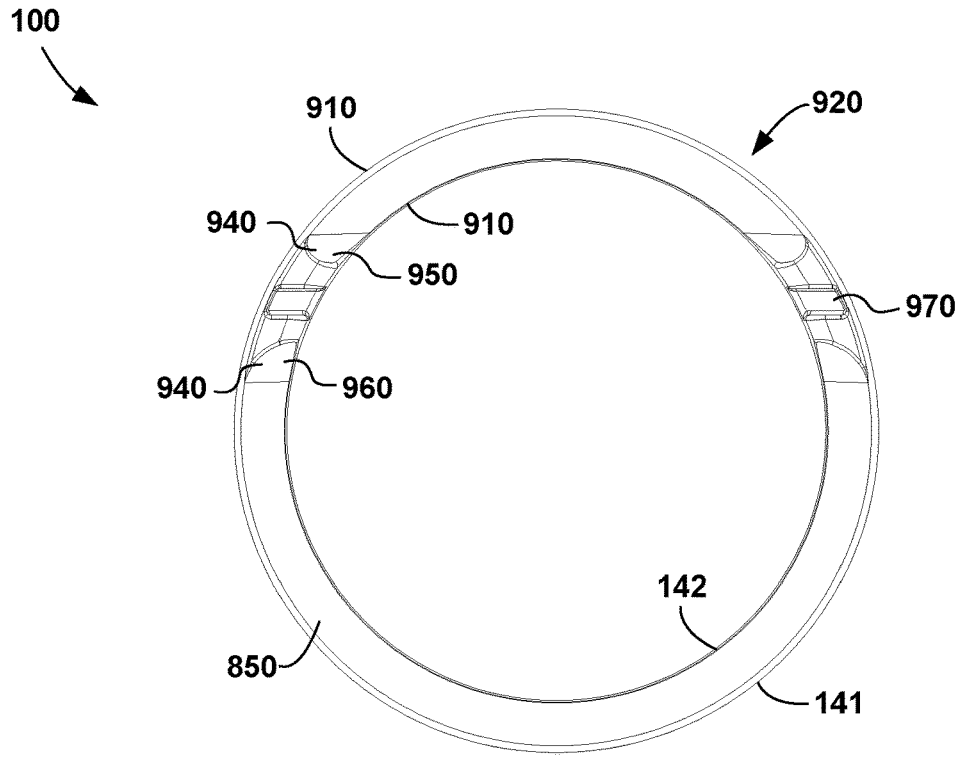
FIG. 9 shows a top view illustrating vessel-rim protector, according to the preferred embodiment of FIG. 8.

FIG. 8 shows an exploded perspective view of a paint-vessel protector 810 of paint-roller system 100, illustrating vessel-rim protector 820 and paint-tool scraper 830 according to a preferred embodiment of the present invention. FIG. 9 shows a top view illustrating vessel-rim protector 820, according to the preferred embodiment of FIG. 8.

Vessel-rim protector 820 preferably comprises a shape, preferably a circular shape, preferably a ring shape (at least herein embodying wherein said at least one paint container rim cover comprises at least one opening access structured and arranged to permit access inside the container with the painting utensil, and at least herein embodying wherein said paint container rim cover means comprises opening access means for permitting access inside the paint container with the painting utensil), as shown. Vessel-rim protector 820 preferably comprises at least one vertical ring 140, preferably at least two vertical rings 140. Vertical rings 140 preferably comprise outer-vertical ring 141 (at least herein embodying wherein said at least one paint container rim cover comprises at least one outer cover structured and arranged to cover the paint container rim on the outside of the paint container, and at least herein embodying wherein said at least one paint container rim cover comprises at least one outer cover structured and arranged to cover the paint container rim on the outside of the paint container, and at least herein embodying wherein said paint container rim cover means comprises outer cover means for covering the paint container rim on the outside of the paint container) and inner-vertical ring 142 (at least herein embodying wherein said at least one paint container rim cover comprises at least one inner cover structured and arranged to cover the paint container rim on the inside of the paint container, and at least herein embodying wherein said paint container rim cover means comprises inner cover means for covering the paint container rim on the inside of the paint container), as shown. Vertical rings 140 preferably comprise top edge 910 (See FIG. 3) and bottom edge 410 (See FIG. 4). Vertical rings 140 preferably comprise inner surface 144, as shown and outer surface 146 (not shown).

Vessel-rim protector 820 preferably further comprises a horizontal-chamfered ring 150 (at least herein embodying wherein said at least one paint container rim cover comprises at least one paint-scrape edge structured and arranged to permit scraping of excess paint from the utensil, and at least herein embodying wherein said paint container rim cover means comprises paint-scrape edge means for permitting scraping of excess paint from the paint utensil, and at least herein embodying wherein said at least one paint container rim cover comprises at least one paint drain structured and arranged to drain excess paint from said at least one paint-scrape edge back into the paint container while preventing contact of the paint with the paint container rim, and at least herein embodying wherein said paint container rim cover means comprises paint drain means for draining excess paint from said paint scrape edge means back into the paint container while preventing contact of the paint with the paint container rim), as shown. In a preferred embodiment, horizontal-chamfered ring 850 preferably comprises ring width F for use with a five-gallon paint bucket. Horizontal-chamfered ring 850 preferably comprises top surface 152, as shown and bottom surface 154 (not shown). Horizontal-chamfered ring 850 further comprises outer edge 920 and inner edge 930, as shown.

Outer-vertical ring 141 preferably comprises a circumference. Preferably the circumference is slightly larger than the outer circumference of upper lip of five-gallon paint bucket 105, as shown. Inner-vertical ring 142 preferably comprises a circumference. Preferably the circumference is slightly smaller than the inner circumference of paint bucket 105.

Inner-vertical ring 142 of vessel-rim protector 820 is preferably situate inside of outer-vertical ring 141 (see FIG. 9). Preferably horizontal-chamfered ring 850 is injection molding attached to inner-vertical ring 142 and outer-vertical ring 141. The inner edge 930 of horizontal-chamfered ring 850 is situate flush with inner surface 144 of inner-vertical ring 142, as shown. Outer-vertical ring 141 is preferably outwardly flared to match the chamfering of horizontal-chamfered ring 850. Horizontal-chamfered ring 850 is situate flush with top edge 910 of outer-vertical ring 141, as shown.

Vessel-rim protector 820 preferably further comprises at least one protector-stabilizer 840, as shown. Protector-stabilizers 840 are preferably injection molding attached to outer surface 146 of outer-vertical ring 141, and are situate equidistant from each other around the circumference of outer-vertical ring 141, as shown.

Vessel-rim protector 820 preferably further comprises at least one scraper tab 940 (at least herein embodying wherein said at least one paint roller screen and said at least one paint container rim cover comprise at least one screen-cover coupler structured and arranged to couple said at least one paint container rim cover and said at least one paint roller screen, and at least herein embodying wherein said paint roller screen means and said paint container rim cover means comprise screen-cover coupler means for coupling said paint container rim cover means and said paint roller screen means), preferably at least four scraper tabs 940, as shown. Scraper tabs 940 preferably comprise a front flat surface 942 and a rear angled surface 944, as shown. Scraper tabs 940 preferably comprise at least two rear scraper tabs 950 and at least two front scraper tabs 960, as shown. Scraper tabs 940 are preferably upward protrusions on horizontal-chamfered ring 850. Rear scraper tabs 950 are preferably injection molding attached to horizontal-chamfered ring 850, and are situate at the "rear" ⅓ of horizontal-chamfered ring 850, as shown. Rear scraper tabs 950 are preferably injection molding attach to top surface 152 of horizontal-chamfered ring 850 facing such that front flat surface 942 faces forward (toward the "front" ⅔) of paint bucket 105. Front scraper tabs 960 preferably injection molding attach to upper surface 152 of horizontal-chamfered ring 850, facing rearward (toward the "rear" ⅓) of paint bucket 105, as shown. Front scraper tabs 960 and rear spacer tabs 950 are attached to upper surface 152 of horizontal-chamfered ring 850 width E (See FIG. 8) apart from each other to create scraper-engager groove 970 (at least herein embodying wherein said at least one screen-cover coupler comprises at least one slot-and-tab coupler, and at least herein embodying wherein said screen-cover coupler comprises at least one slot-and-tab coupler), as shown.

Figure 10:
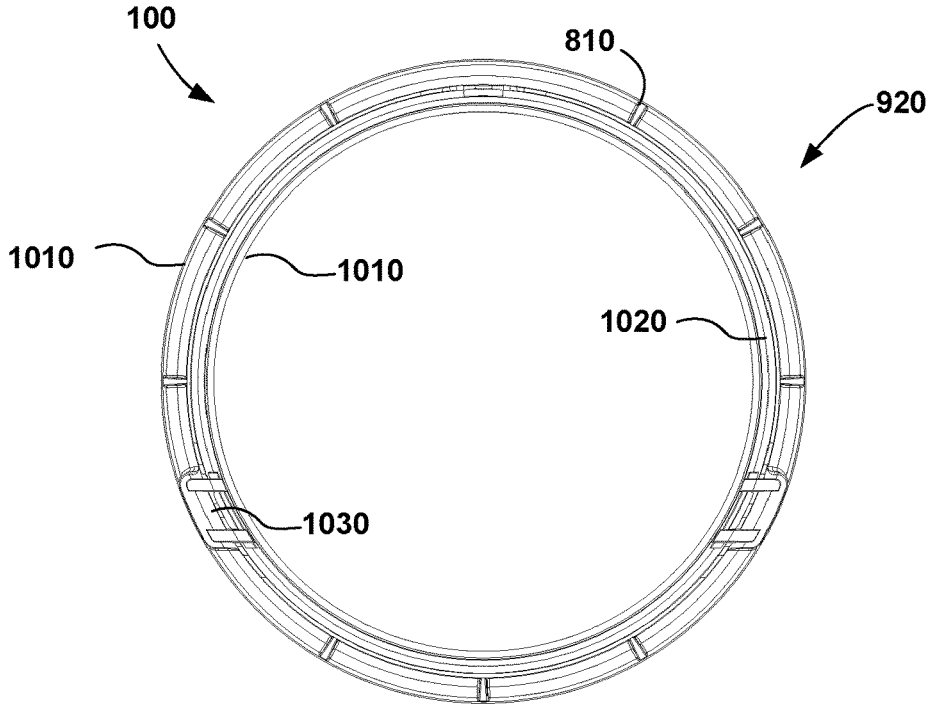
FIG. 10 shows a bottom view illustrating vessel-rim protector, according to the preferred embodiment of FIG. 8.
Figure 11:
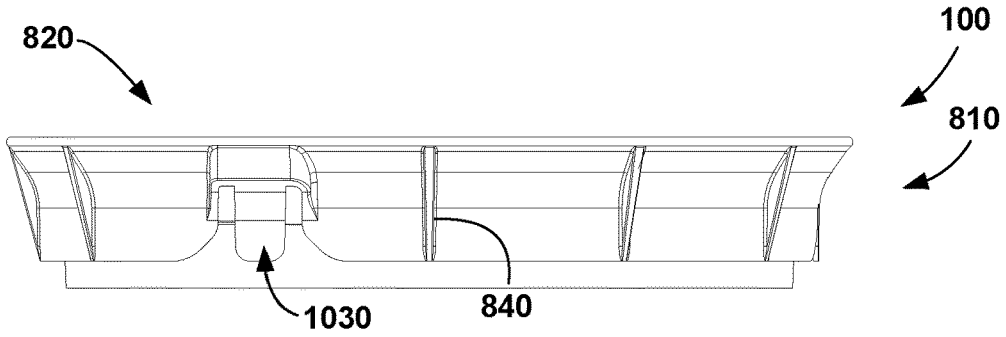
FIG. 11 shows a side view illustrating vessel-rim protector, according to the preferred embodiment of FIG. 8.

FIG. 10 shows a bottom view illustrating vessel-rim protector 820, according to the preferred embodiment of FIG. 8. FIG. 11 shows a side view illustrating vessel-rim protector 820, according to the preferred embodiment of FIG. 8. The underside of vessel-rim protector 820 preferably comprises vessel-engagement groove 1020 created by the space between inner-vertical ring 142 and outer-vertical ring 141. Outer-vertical ring 141 preferably further comprises at least one rim-protector releaser 1030, preferably at least two rim-protector releasers 1030 (See FIG. 10). Rim-protector releaser (at least herein embodying wherein said at least one screen-cover coupler is decoupleable, and at least herein embodying wherein said screen-cover coupler means is decoupleable) 1030 preferably comprises a gap in outer-vertical ring 141 which is situate directly below each scraper-engager groove 970. Rim-protector releaser 1030 preferably allows a space in vessel-rim protector 820 for a user to lift vessel-rim protector 820 up and off of paint bucket 105.

Figure 12:
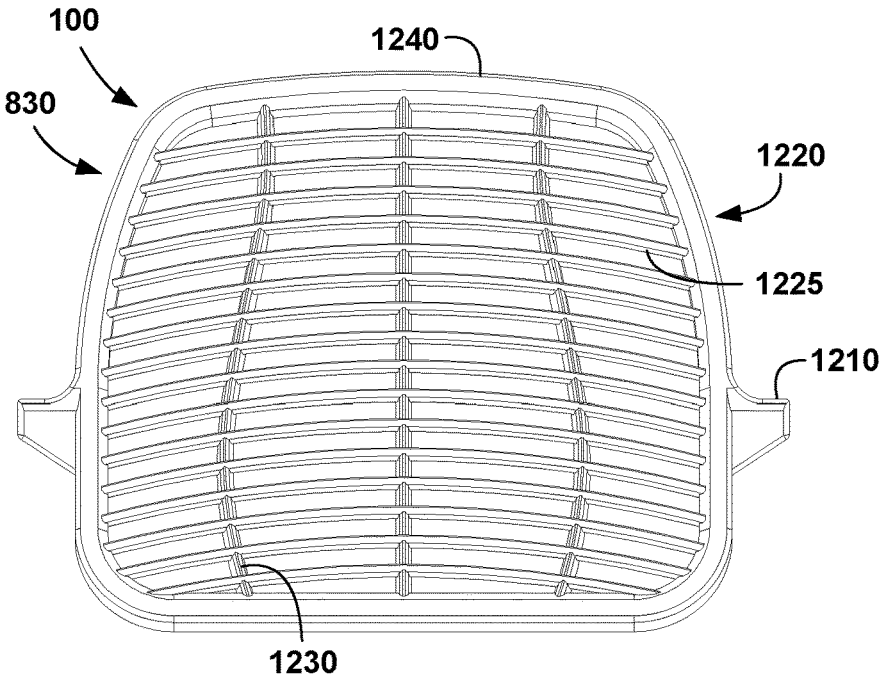
FIG. 12 shows a front view illustrating paint-tool scraper, according to the preferred embodiment of FIG. 8.

FIG. 12 shows a front view illustrating paint-tool scraper 830, according to the preferred embodiment of FIG. 8. Paint-tool scraper 830 preferably comprises a shape, preferably a rounded square shape. Upon reading the teachings of this specification, those skilled in the art will now appreciate that, under appropriate circumstances, considering such issues as, future manufacturing methods, cost, structural requirements, available materials etc., other shapes, such as, for example, rectangular, pentagonal, trapezoidal, oval, etc., may suffice. Paint-tool scraper 830 preferably comprises a solid frame 1240, as shown. Paint-tool scraper 830 preferably further comprises scraper-screen 1220 constructed with a series of horizontal slats 1225 spaced equidistant apart inside solid frame 1240, as shown. Additionally, paint-tool scraper 830 preferably comprises vertical-reinforcers 1230 spaced equidistant apart inside solid frame 1240, as shown.

Figure 13:
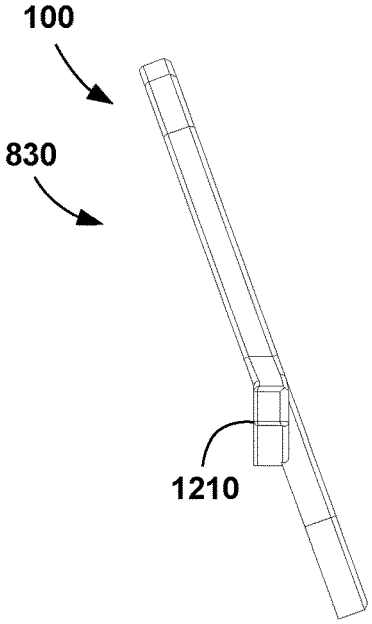
FIG. 13 shows a side view illustrating paint-tool scraper, according to the preferred embodiment of FIG. 8.

FIG. 13 shows a side view illustrating paint-tool scraper 830, according to the preferred embodiment of FIG. 8. Paint-tool scraper 830 preferably comprises at least one rim-protector engager 1210, preferably at least two rim-protector engagers 1210, as shown. Rim-protector engagers 1210 are preferably vertical protruding tabs which are injection molding attached to paint-tool scraper 830 at an approximately 45 degree angle to the vertical sides of solid frame 1240, as shown. Rim-protector engagers 1210 are preferably attached to paint-tool scraper 830 about ⅓ from one end of paint-tool scraper 830, as shown. Rim-protector engagers 1210 preferably comprise a width E which is approximately equal to width E of scraper-engager groove 970.

In use, when a user is preparing to paint exterior or interior walls, trim or ceiling of a structure, or any other item which he/she may wish to paint, he/she will remove the lid from the paint bucket. Consequently, to use paint-roller system, vessel-rim protector 120 will be placed on the rim of paint bucket 105 and snapped securely down over the rim of the paint bucket 105. Once vessel-rim protector 120 is securely in place on the rim of the bucket, the user would then place paint-tool scraper 830 into vessel-rim protector 120 by engaging rim-protector engagers 1210 with scraper tabs 940 which seat into scraper-engager grooves 970 (at least herein embodying wherein said at least one paint roller screen is positioned over said at least one opening access when coupled with said at least one paint container rim cover, and at least herein embodying wherein said paint roller screen means is positioned over said opening access means when coupled with said paint container rim cover means), as shown. A user would then dip a paint tool (roller or brush) into the paint, and using paint-tool scraper 830 would remove any excess paint from the paint tool. Due to the chamfered (beveled) construction of horizontal-chamfered ring 150, all excess paint would run/drip into paint bucket instead of spraying out or running/dripping on the floor or other support surface.

Figure 2:
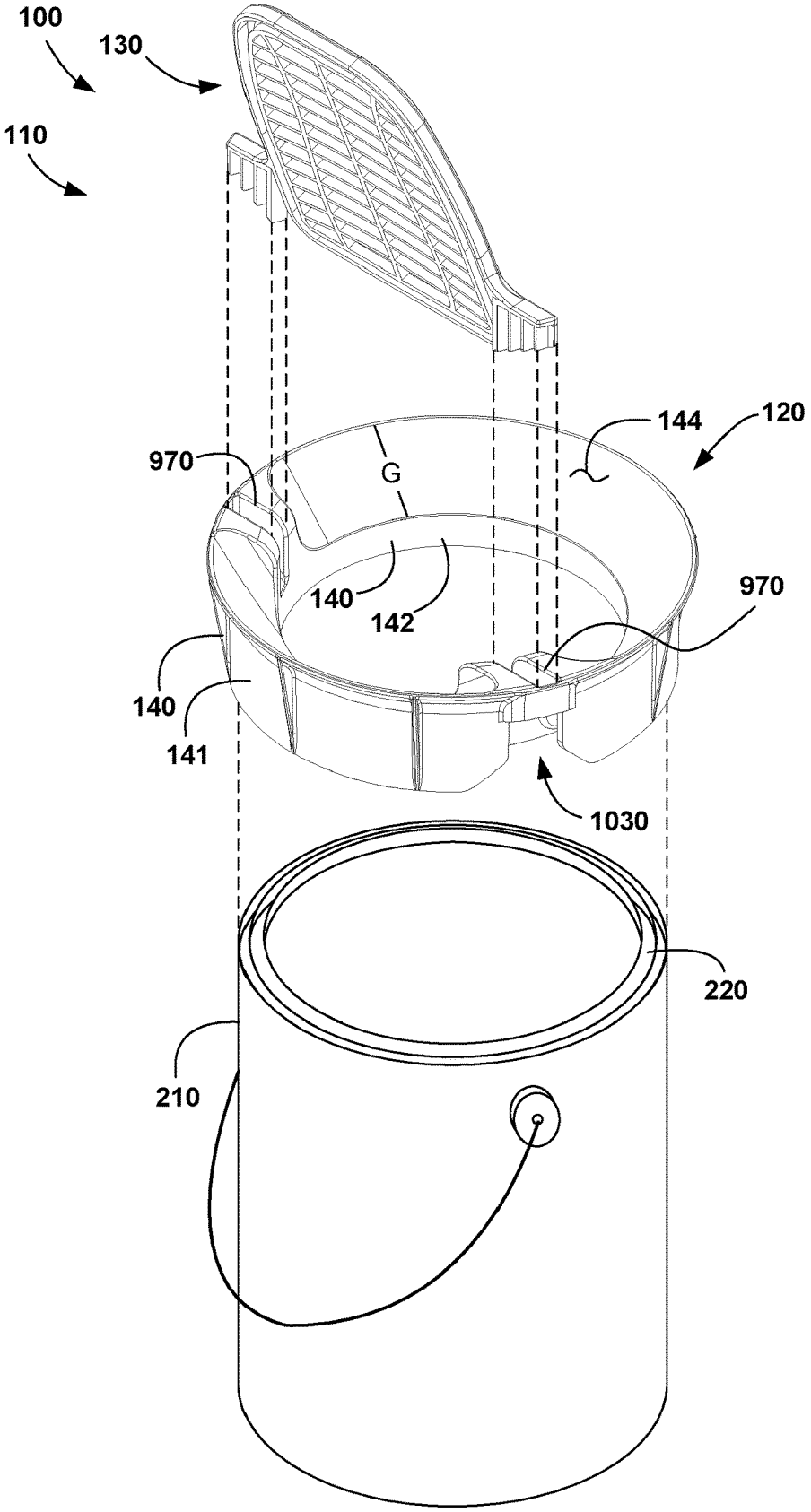
FIG. 2 shows an exploded perspective view of an alternately, illustrating vessel-rim protector and paint-tool scraper, according to the alternately preferred embodiment of FIG. 1.
Figure 3:
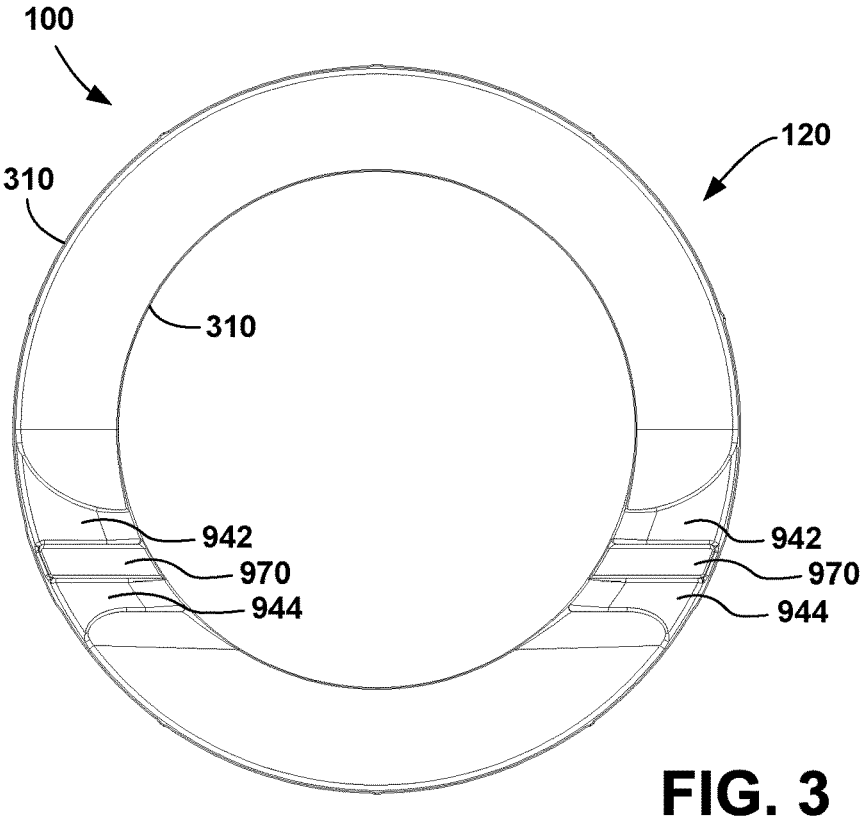
FIG. 3 shows a top view, illustrating vessel-rim protector, according to the alternately preferred embodiment of FIG. 2.

FIG. 2 shows an exploded perspective view of an alternately, illustrating vessel-rim protector 120 and paint-tool scraper 130, according to the alternately preferred embodiment of FIG. 1. Many of the features of vessel-rim protector 120 are repeated from preferred vessel-rim protector 820 in paint-roller system 100, as shown. In an alternately preferred embodiment of paint-roller system 100, vessel-rim protector 120 preferably comprises horizontal-chamfered ring 150 (at least herein embodying wherein said at least one paint drain comprises at least one sloped surface extending from said at least one paint scrape edge inward and downward to said at least one opening access, and at least herein embodying wherein said paint drain comprises at least one sloped surface extending from said paint scrape edge means inward and downward to said opening access means), as shown. Horizontal-chamfered ring 150 preferably comprises ring width G for use with a paint can, as shown. FIG. 3 shows a top view, illustrating vessel-rim protector, according to the alternately preferred embodiment of FIG. 2.

Figure 4:
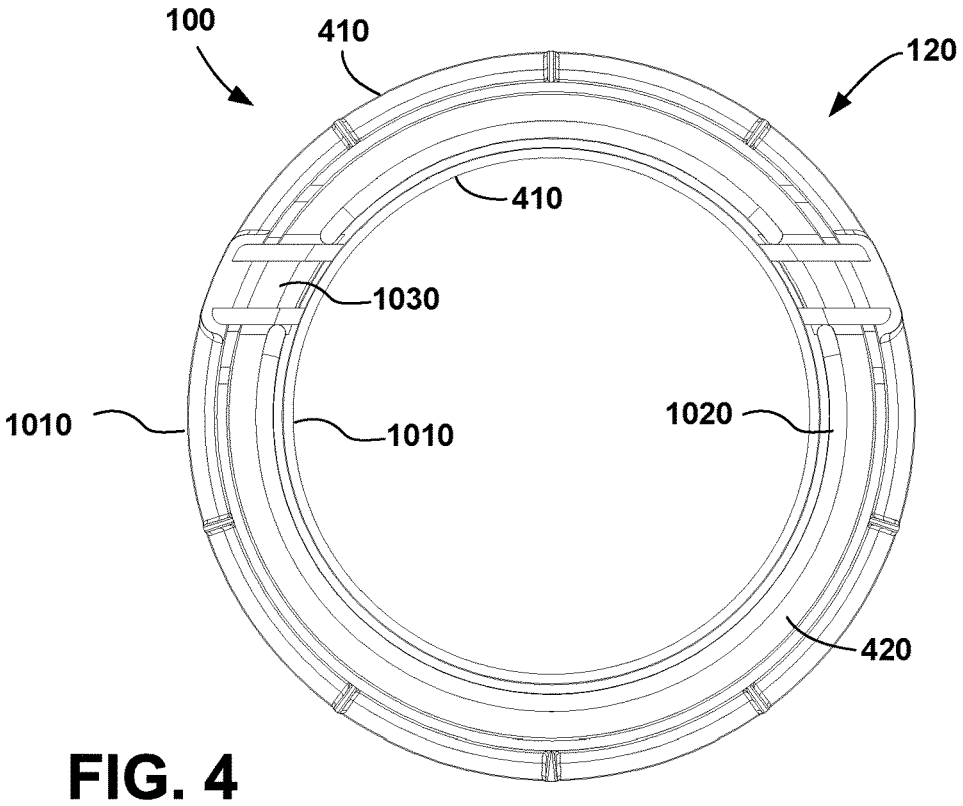
FIG. 4 shows a bottom view illustrating vessel-rim protector, according to the preferred embodiment of FIG. 2.
Figure 5:
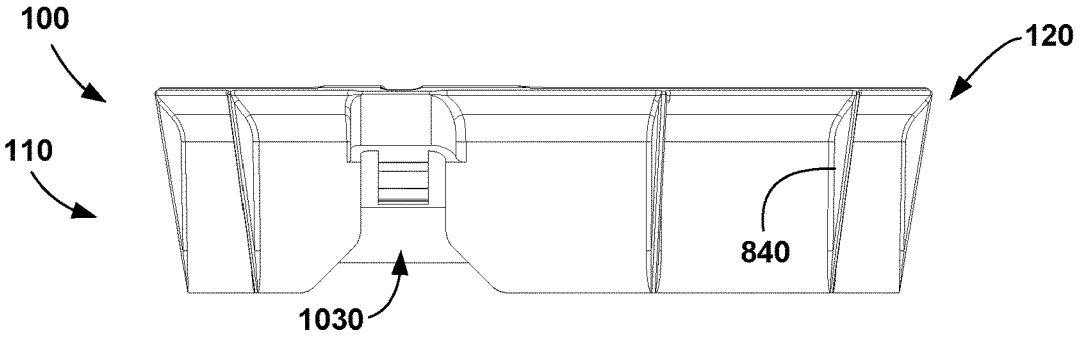
FIG. 5 shows a side view illustrating vessel-rim protector, according to the alternately preferred embodiment of FIG. 2.

FIG. 4 shows a bottom view illustrating vessel-rim protector, according to the preferred embodiment of FIG. 2. In an alternately preferred embodiment of paint-roller system 100, vessel engagement groove 1020 preferably comprises mid-wall 420 which is situate between inner-vertical ring 142 and outer-vertical ring 141. Mid-wall 420 preferably comprises a rounded wall injection molding formed between inner-vertical ring 142 and outer-vertical ring 141. Mid-wall 420 comprises a width approximately equal to the width of lid-engager groove 220 of paint can 210, as shown. FIG. 5 shows a side view illustrating vessel-rim protector, according to the alternately preferred embodiment of FIG. 2.

Figure 6:
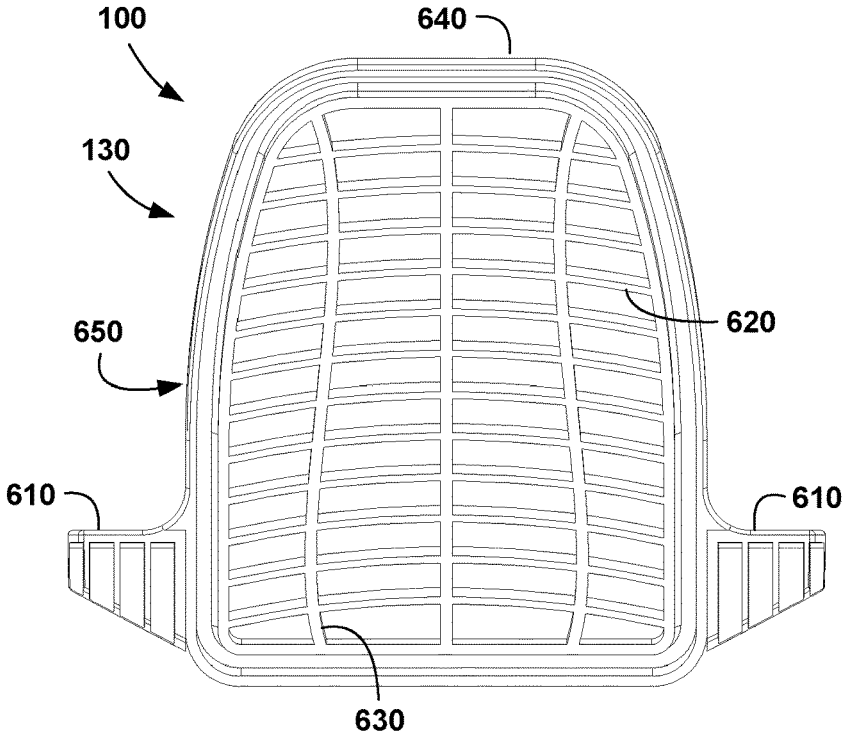
FIG. 6 shows a front view illustrating paint-tool scraper, according to the alternately preferred embodiment of FIG. 2.

FIG. 6 shows a front view illustrating paint-tool scraper, according to the alternately preferred embodiment of FIG. 2. Many of the features of paint-tool scraper 130 are repeated from preferred paint-tool scraper 830 in paint-roller system 100, as shown. Paint-tool scraper 130 preferably comprises a shape, preferably a rounded rectangular shape. Upon reading the teachings of this specification, those skilled in the art will now appreciate that, under appropriate circumstances, considering such issues as, future manufacturing methods, cost, structural requirements, available materials etc., other shapes, such as, for example, square, pentagonal, trapezoidal, oval, etc., may suffice. Paint-tool scraper 130 preferably comprises a solid frame 640, as shown. Paint-tool scraper 130 preferably further comprises scraper-screen 650 constructed with a series of horizontal slats 620 spaced equidistant apart inside solid frame 640, as shown. Additionally, paint-tool scraper 130 preferably comprises vertical-reinforcers 630 spaced equidistant apart inside solid frame 640, as shown.

Figure 7:
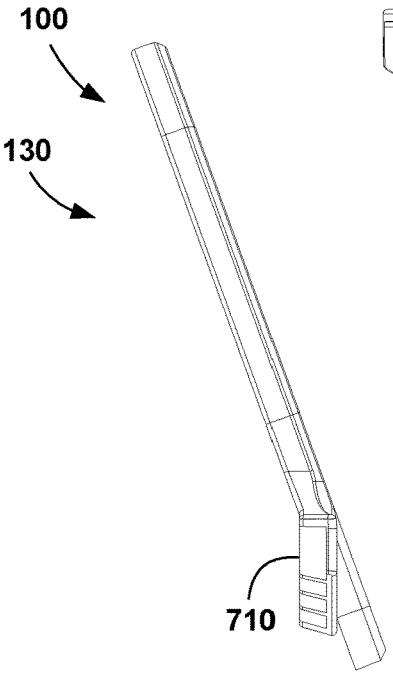
FIG. 7 shows a side view illustrating paint-tool scraper, according to the alternately preferred embodiment of FIG. 2.

FIG. 7 shows a side view illustrating paint-tool scraper 130, according to the alternately preferred embodiment of FIG. 2. Paint-tool scraper 130 preferably comprises at least one rim-protector engager 610, preferably at least two rim-protector engagers 610, as shown. Rim-protector engagers 610 are preferably vertical protruding tabs which are injection molding attached to paint-tool scraper 130 at an approximately 45 degree angle to the vertical sides of solid frame 640, as shown. Rim-protector engagers 610 are preferably attached to paint-tool scraper 130 at the lower edge of paint-tool scraper 830, as shown. Rim-protector engagers 610 preferably comprise a width E which is approximately equal to width E of scraper-engager groove 970. Rim-protector engagers 610 preferably protrude outward from solid frame 640 a distance approximately equal to width G of horizontal-chamfered ring 150 providing stabilization of paint-tool scraper 130 when inserted into scraper-engager grooves 970, as shown.

In use, when a user is preparing to paint exterior or interior walls, trim or ceiling of a structure, or any other item which he/she may wish to paint, he/she will remove the lid from the paint can. Consequently, to use paint-roller system, vessel-rim protector 120 will be placed on the rim of paint can 210 and snapped securely down over the top lip of the paint can 210, and mid-wall 420 on the inside of vessel-rim protector 120 seats into lid-engager groove 220 of paint can 210. Once vessel-rim protector is securely in place on the rim of the can, the user would then place paint-tool scraper 130 into vessel-rim protector 120 by engaging rim-protector engagers 610 with scraper tabs 940 which seat into scraper-engager grooves 970. A user would then dip a paint tool (roller or brush) into the paint, and using paint-tool scraper 130 would remove any excess paint from the paint tool. Due to the chamfered (beveled) construction of horizontal-chamfered ring 150, all excess paint would run/drip into paint bucket/can instead of spraying out or running/dripping on the floor or other support surface.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to preventing paint from contacting a paint container rim while using paint directly from a paint container with a painting utensil, comprising:

a) at least one paint container rim cover structured and arranged to cover the paint container rim;

b) wherein said at least one paint container rim cover comprises i) at least one rim coupler structured and arranged to couple said at least one paint container rim cover with the paint container rim, ii) at least one opening access structured and arranged to permit access inside the paint container with the painting utensil, iii) at least one paint-scrape edge structured and arranged to permit scraping of excess paint from the paint utensil, and iv) at least one paint drain structured and arranged to drain excess paint from said at least one paint scrape edge back into the paint container while preventing contact of paint with the paint container rim;

c) at least one paint roller screen structured and arranged to permit screening out excess paint from a paint roller; and d) wherein said at least one paint roller screen and said at least one paint container rim cover comprise at least one screen-cover coupler structured and arranged to couple said at least one paint container rim cover and said at least one paint roller screen.

2. The system according to claim 1 wherein said at least one paint roller screen is positioned over said at least one opening access when coupled with said at least one paint container rim cover.

3. The system according to claim 1 wherein said at least one paint container rim cover comprises plastic.

4. The system according to claim 1 wherein said at least one paint roller screen comprises plastic.

5. The system according to claim 1 wherein said at least one screen-cover coupler is decoupleable.

6. The system according to claim 1 wherein said at least one screen-cover coupler comprises at least one slot-and-tab coupler.

7. The system according to claim 1 wherein said at least one paint container rim cover comprises:

a) at least one inner cover structured and arranged to cover the paint container rim on the inside of the paint container; and b) at least one outer cover structured and arranged to cover the paint container rim on the outside of the paint container.

8. The system according to claim 1 wherein said at least one paint drain comprises at least one sloped surface extending from said at least one paint scrape edge inward and downward to said at least one opening access.

9. A system, relating to preventing paint from contacting a paint container rim while using paint directly from a paint container with a painting utensil, comprising:

a) paint container rim cover means for covering the paint container rim;

b) wherein said paint container rim cover means comprises i) rim coupler means for coupling said paint container rim cover means with the paint container rim, ii) opening access means for permitting access inside the paint container with the painting utensil, iii) paint-scrape edge means for permitting scraping of excess paint from the paint utensil, and iv) paint drain means for draining excess paint from said paint scrape edge means back into the paint container while preventing contact of paint with the paint container rim;

c) paint roller screen means for permitting screening out excess paint from a paint roller; and d) wherein said paint roller screen means and said paint container rim cover means comprise screen-cover coupler means for coupling said paint container rim cover means and said paint roller screen means.

10. The system according to claim 9 wherein said paint roller screen means is positioned over said opening access means when coupled with said paint container rim cover means.

11. The system according to claim 9 wherein said paint container rim cover means comprises plastic.

12. The system according to claim 9 wherein said paint roller screen means comprises plastic.

13. The system according to claim 9 wherein said screen-cover coupler means is decoupleable.

14. The system according to claim 9 wherein said screen-cover coupler comprises at least one slot-and-tab coupler.

15. The system according to claim 9 wherein said paint container rim cover means comprises:

a) inner cover means for covering the paint container rim on the inside of the paint container; and b) outer cover means for covering the paint container rim on the outside of the paint container.

16. The system according to claim 9 wherein said paint drain comprises at least one sloped surface extending from said paint scrape edge means inward and downward to said opening access means.

* * * * *